United States Patent [19]

Wsyk

[11] Patent Number: 4,895,463

[45] Date of Patent: Jan. 23, 1990

[54] MATRIX PRINT HEAD

[75] Inventor: Hans J. Wsyk, Villingen, Fed. Rep. of Germany

[73] Assignee: Mannesmann Aktiengesellschaft, Düsseldorf, Fed. Rep. of Germany

[21] Appl. No.: 137,437

[22] Filed: Dec. 23, 1987

[30] Foreign Application Priority Data

Dec. 23, 1986 [DE] Fed. Rep. of Germany ..... 3644185

[51] Int. Cl.[4] ..... B41J 3/12

[52] U.S. Cl. ..... 400/124; 101/93.05; 335/237

[58] Field of Search ..... 335/237; 101/93.05; 400/124

[56] References Cited

U.S. PATENT DOCUMENTS

| | | | |
|---|---|---|---|
| 885,688 | 4/1908 | Cubitt | 335/237 |
| 1,632,609 | 6/1927 | Lee | 335/237 |
| 4,225,250 | 9/1980 | Wagner | 400/124 |
| 4,377,348 | 3/1983 | Isobe | 400/124 |
| 4,428,691 | 1/1984 | Suzuki | 400/124 |
| 4,433,926 | 2/1984 | Isobe | 400/124 |
| 4,513,496 | 4/1985 | Wang | 400/124 |
| 4,521,122 | 6/1985 | Schafer | 400/124 |

*Primary Examiner*—Paul T. Sewell
*Attorney, Agent, or Firm*—Horst M. Kasper

[57] ABSTRACT

A matrix print head is provided with electromagnetic circuits coordinated to individual dot-print elements (10), where the dot-print elements (10) are attached in each case to spring armatures (11). The armatures are in each case disposed opposite to a coil core (12) of an electromagnetic coil (14), and the armature (11), the coil core (12), a back plate (16), a permanent magnet (17), and a yoke plate (18) form a main-series magnetic circuit (19), where the armature (11) rests in its rest position on the coil core (12). In addition, a shunt magnetic circuit (20) is coordinated to each main-series magnetic circuit (19), where the shunt magnetic circuit is formed by the back plate (16), by the permanent magnet (17), the yoke plate (18), and by a shunt ring (21). The magnetic reluctance of the shunt magnetic circuit (20) is kept substantially constant over temperature ranges in order to save expensive tuning apparatus, to balance possible production tolerances, and to improve the dynamic part of the pin-print head in an optimum way relative to magnetic force and expended energies. The permanent magnet (17) of the main-series magnetic circuit (19) is dimensioned substantially lower than the corresponding electromagnetic coil (14).

23 Claims, 2 Drawing Sheets

MATRIX PRINT HEAD

BACKGROUND OF THE INVENTION

1. Field of the Invention

The invention relates to a matrix print head with individual dot-print elements, with electromagnetic circuits coordinated to the individual dot-print elements, where the dot-print elements, in each case, are attached to spring armatures or anchors which, in each case, are disposed opposite to a coil core of an electromagnetic coil and where the armature, the core of the coil, a back plate, a permanent magnet, and a yoke plate form a main-series magnetic circuit, where the armature in the rest position rests on the coil core.

2. Brief Description of the Background of the Invention Including Prior Art

Such matrix print heads require a high writing capacity and, at the same time, a long lifetime and durability. The requirements necessary for this purpose aim at a high degree of effectiveness of the magnetic flux circuit and at achieving in continuous operation a low heating of the matrix print head through low power dissipation.

A matrix print head is known from the German Patent DE-PS 3,110,798. However, the construction according to this patent is associated with the disadvantage that the magnetic flux of a permanent magnet is lower in a high-temperature state as compared to room temperature. The known teaching furthermore has as a starting point to consider the stable operation of the print head at the high temperature as a most substantial viewpoint. Correspondingly, the object of the conventional teaching is to improve a print head of the kind indicated there such that the print head can operate even at high temperatures in a continuous manner, at a high speed, and by providing a good printing quality.

In contrast, the following points have to be considered also. A magnetic circuit of the kind of the reference is associated with substantial dimensional variations and with deviations based on the manufacturing and material tolerances of the individual parts as well as based on the assembly procedures. For example, unevenesses of the back plate and of the yoke ring can occur. During assembly, different rest positions of the armature occur in the magnetic circuit from armature to armature, which are based on so-called joining tolerances. In addition, one has to expect magnetic tolerances of the permanent magnets, i.e. there is a changing remanence and a changing coercive force. The same holds for the soft-magnetic material, where the desired homogeneity cannot be achieved during their production process. All imponderables taken together result finally in an inadequate printed writing based on different magnetic circuit forces in conjunction with the dynamic part of the armature plate of the spring armature. Forced or compulsory overdimensioning of the parts and of the forces results in a negative influence on the functioning. Other known matrix print head constructions have already attempted to resolve this problem by magnetizing and weakening of the magnet to a certain operating point of the magnet. However, for this purpose, expensive and complicated apparatus is required for tuning of the operating point.

SUMMARY OF THE INVENTION

1. Purposes of the Invention

It is an object of the present invention to improve the magnetic circuit and, in addition, the dynamic part of the pin print head in an optimum way with respect to magnetic force and expended energies in order to avoid problems caused by production tolerances.

It is another object of the present invention to provide a magnetic print head which results in less heat generation caused by required power input into the magnetic head.

It is yet another object of the present invention to provide a reliable operation of the print pins of a matrix print head under less energy input.

These and other objects and advantages of the present invention will become evident from the description which follows.

2. Brief Description of the Invention

The present invention provides for a matrix print head comprises an individual pin print element. An electromagnetic coil forming part of an electromagnetic circuit is coordinated to the individual pin print element. A coil core is disposed in the electromagnetic coil. The matrix print head furthermore comprises a back plate and a yoke plate. A permanent magnet is furnished substantially lower than the corresponding electromagnetic coil. The individual pin print element is attached to a springing armature, which springing armature is disposed opposite to the coil core of the electromagnetic coil. The armature, the core of the coil, the back plate, the permanent magnet, and the yoke plate form a main-series magnetic circuit. The springing armature rests in its rest position on the core of the coil. A soft magnetic shunt ring forms part of a shunt magnetic circuit coordinated to the main series magnetic circuit. Said shunt magnetic circuit is formed by the back plate, the permanent magnet, the yoke plate, and a shunt ring.

The magnetic properties of the shunt ring can reduce the magnetic reluctance of the magnetic circuit passing through the coil by at least about 20 percent.

Preferably, the material for the shunt ring comprises materials selected from the group consisting of silicon iron and of magnetic materials having a maximum permeability of at least 7000 at a coercitivity of less than 0.3 and a magnetic flux of at least up to 20,000 gauss.

The thickness of the shunt ring can be variable depending on the main-series magnetic circuit including the permanent magnet based on a supply of several shunt rings with different thicknesses furnished for determination of an optimal operating point.

The magnetic shunt ring can be produced from a rolled metal alloy and the circumferential direction can coincide with the direction of the rolling.

The material for the permanent magnet (17) can be selected from the group consisting of cobalt samarium alloy (CoSm), magnetical high remanence materials having a Curie temperature of at least about 700° C., and mixtures thereof.

Preferably, the magnetic flux, generated by the coil when energized, is increased by at least about 10 percent and more preferably by at least about 25 percent by a shunt ring extending in a direction parallel to the coil axis and connecting the back plate and the yoke for decreasing the magnetic reluctance encountered by the magnetic field generated by the coil.

The total extension of the shunt ring in a direction parallel to an axis of the coil can be at least two times the extension of the permanent magnet in the same direction. The magnet ring can be disposed within the cylinder formed by the shunt ring.

The shunt ring can have a center of gravity. Preferably, the magnet ring does not extend in axial direction, from a plane perpendicular to the axis of the shunt ring and passing through the center of gravity, by more than 0.4 times the total extension of the shunt ring in axial direction.

The shunt ring can have an extension in a direction parallel to the axis of the shunt ring of at least 0.7 times the length in axial direction of the coil core and of not more than the length in axial direction of the coil core.

Preferably, the extension in axial direction of the shunt ring is at least twenty times the thickness of the shunt ring.

The shunt ring can overlap the back plate over a length in axial direction of at least 0.8 times the length in axial direction of the back plate. The shunt ring can overlap the yoke plate in axial direction by at least about 0.5 times the extension of the yoke plate in axial direction. The distance of the shunt ring from the magnet ring can be less than the thickness of the shunt ring.

According to another aspect of the invention, there is provided a method for reducing electrical energy input into matrix print heads comprising the following: A coil core is disposed in an electromagnetic coil coordinated to an individual pin print element. A back plate is placed on a rear side of the electromagnet coil. A permanent magnet ring is disposed eccentrically around the electromagnetic coil and the permanent magnet neighbors the back plate on the front side of the back plate. A yoke plate is disposed eccentrically around the electromagnetic coil and the yoke plate neighbors the front side of the permanent magnet ring. An individual pin print element is attached to a springing armature. The springing armature is positioned opposite to the coil core of the electromagnetic coil such that the armature, the core of the coil, the back plate, the permanent magnet, and the yoke plate form a main-series magnetic circuit. A shunt ring surrounds the permanent magnet ring for forming a shunt magnetic circuit coordinated to the main-series magnetic circuit. This shunt magnetic circuit is formed by the back plate, the permanent magnet, the yoke plate, and a shunt ring. The electromagnetic coil is energized for moving the springing armature from its rest position on the coil core to a position at a distance from the core coil.

In accordance with the present invention, the magnetic reluctance of the shunt magnetic circuit is maintained substantially constant in case of temperature differences, where the permanent magnet of the main-series magnetic circuit is substantially lower as compared to the respective electromagnetic coil. Compared with the state of the art, there is no temperature compensation present but an intentional weakening of the main-series magnetic circuit with the effect that, upon lifting of the permanent magnetic field by the electromagnetic coil, with the purpose to place the print pin element together with the armature into a printing motion, there is applied a lesser current strength onto the electromagnetic coil. The savings in current amount to about 25 to 30%, as measurements have indicated at a matrix print head of this construction.

This savings in current results in a lesser heating during continuous operation such that a longer durability of the matrix print head can be achieved. In addition, the advantage exists of a light-weight, inexpensive tuning of the magnetic flux, when an increase of the air-gap between the armature and the coil core exists, caused by wear. The tuning is equivalent to an increase of the magnetic circuit. Based on the slowly occurring wear occurring between armature and the core of the coil, the air gap and thus the armature stroke becomes larger with increased lifetime of the matrix print head. Simultaneously, the threshold values, measured in milliamperes, for releasing and for pulling in at the electromagnetic coil, decrease up to the point where the magnetic circuit can no longer hold, maintain or, respectively, pull in a spring armature. This state means that the end of the lifetime of the matrix print head has arrived, since an exchange of the magnetic circuit device element cannot be economically undertaken and performed.

Reducing the current intake by 25 to 30% brings about a lower power dissipation and this results in a higher thermal stability at the maximum printing performance, in a savings in cooling bodies, in a reduction of the dimensions of the matrix print head structure, and thus in a savings in weight. The lower power dissipation also affects the driver circuit and requires in this case a lesser expenditure for device components and allows the use of fully integrated circuits in lieu of discrete components and thus increases the safety and stability of operation. The reduction in current intake furthermore is advantageous for the power supply because of the decrease of the power which has to be provided and which allows the use of less expensive components such as, for example, smaller transformers and chokes, and furthermore allows already in the power section the application of integrated circuits and, simultaneously, reduces the steps required for cooling of the components loaded by generation of thermal energy and heat.

A basis for this construction includes that the dimension of the permanent magnet of the main-series magnetic circuit is substantially less than that of the corresponding electromagnetic coil since, in case of a tuned dimensioning of the thickness of the permanent magnet ring, there results a certain electromagnetic coil, comprising of a certain number of ampere windings, which is sufficient in order to decrease or, respectively, cancel the field provided by the permanent magnet at the time of the shooting off of the print elements and print pins.

A further advantageous step, in order to maintain the magnetic reluctance of the shunt magnetic circuit at a constant level, comprises that the material for the shunt ring exhibits a low magnetic reluctance.

According to a further feature, such a magnetically low reluctance can be achieved by employing a material for the shunt magnetic ring such as steel C15, ferro silicon, or the like. Preferably, such materials have a maximum relative permeability of at least about 5,000 and preferably of at least about 7,000 and an initial permeability of at least about 300, and preferably of at least about 500. The coercitivity should preferably be less than 0.5 and more preferred are materials having a coercitivity of less than 0.3. The maximum magnetic flux in the material employed should be at least 15,000 gauss, and more preferred are materials which have a maximum magnetic flux of at least about 20,000 gauss. Alloys which can be employed in this context include alloys containing 4 weight-percent silicon, with the balance being iron.

Advantageously, during the production of the matrix print head, instead of the mentioned expensive measurement device for the tuning of the operating point of the magnetic circuit system, it is preferred to maintain the thickness of the shunt ring variable depending on the main-series magnetic circuit including the permanent magnet and to store several shunt rings with different thicknesses for tuning of the operating point.

In addition, the magnetic shunt ring can be produced from a rolled material, where the circumferential direction of the ring coincides with the rolling direction.

The material for the permanent magnet ring can be cobalt samarium (CoSa) or comparable magnetic materials of substantially equivalent performance, which materials have some influence on the dimensioning of the permanent magnet ring or, respectively, of the electromagnetic coil in an advantageous way. The permanent magnet material has preferably a Curie temperature of at least 600° C. and preferably of more than 700° C.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
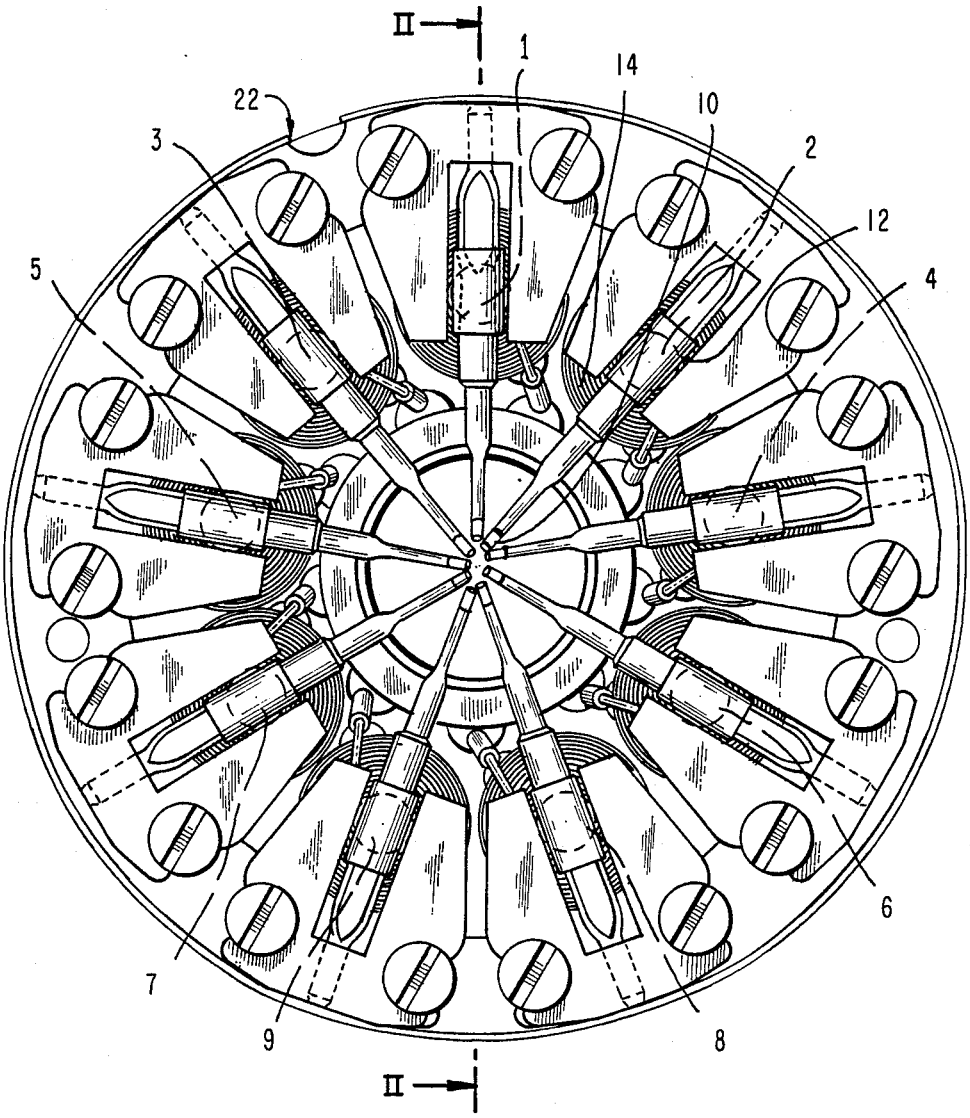
FIG. 1 is a front view of a matrix print head with removed casing in a construction type employing print pins.

A matrix print head with electromagnetic circuits is coordinated to individual pin print elements. The pin print elements are in each case attached to springing armatures which are, in each case, disposed opposite to the coil core of an electromagnetic coil. The armature, the core of the coil, the back plate, a permanent magnet, and a yoke plate form a main-series magnetic circuit. The armature rests in its rest position on the core of the coil. Furthermore a shunt magnetic circuit is coordinated to each main-series magnetic circuit. This shunt magnetic circuit is formed by the back plate, the permanent magnet, the yoke plate, and a shunt ring. The permanent magnet 17 of the main-series magnetic circuit 19 is provided substantially lower than the corresponding electromagnetic coil 14.

The magnetic material for the shunt ring 21 can exhibit a lower magnetic reluctance.

The material for the shunt ring 21 can comprise materials selected from the group consisting of silicon iron and of magnetic materials having a maximum permeability of at least 7000 at a coercitivity of less than 0.3 and a magnetic flux of at least up to 20,000 gauss.

Preferably, the thickness 23 of the shunt ring 21 is variable depending on the main-series magnetic circuit 19 including the permanent magnet 17. Several shunt rings 21 can be furnished with different thicknesses 23 for determination of the operating point.

The magnetic shunt ring 21 can be produced from a rolled metal alloy, where the circumferential direction can coincide with the direction of the rolling.

The material for the permanent magnet 17 can be provided with a cobalt samarium alloy (CoSm) or provided by a material selected from the group consisting of cobalt samarium (CoSm) and magnetically effective materials having a Curie temperature of at least about 700° C.

Preferably, the magnetic field strength and the magnetic flux generated by the coil is increased by a shunt ring extending in a direction parallel to the coil axis and connecting the back plate and the yoke for decreasing the magnetic reluctance encountered by the magnetic field generated by the coil.

Referring now to FIG. 1, the matrix print head exhibits electromagnetic circuits designated with the reference numerals 1 to 9. A print pin 10 is coordinated in each case to an electromagnetic circuit as a dot-print element. Each electromagnetic circuit 1 to 9 is provided with a spring armature 11 (FIG. 2) and the print pin 10 is attached to the spring armature 11.

Figure 2:
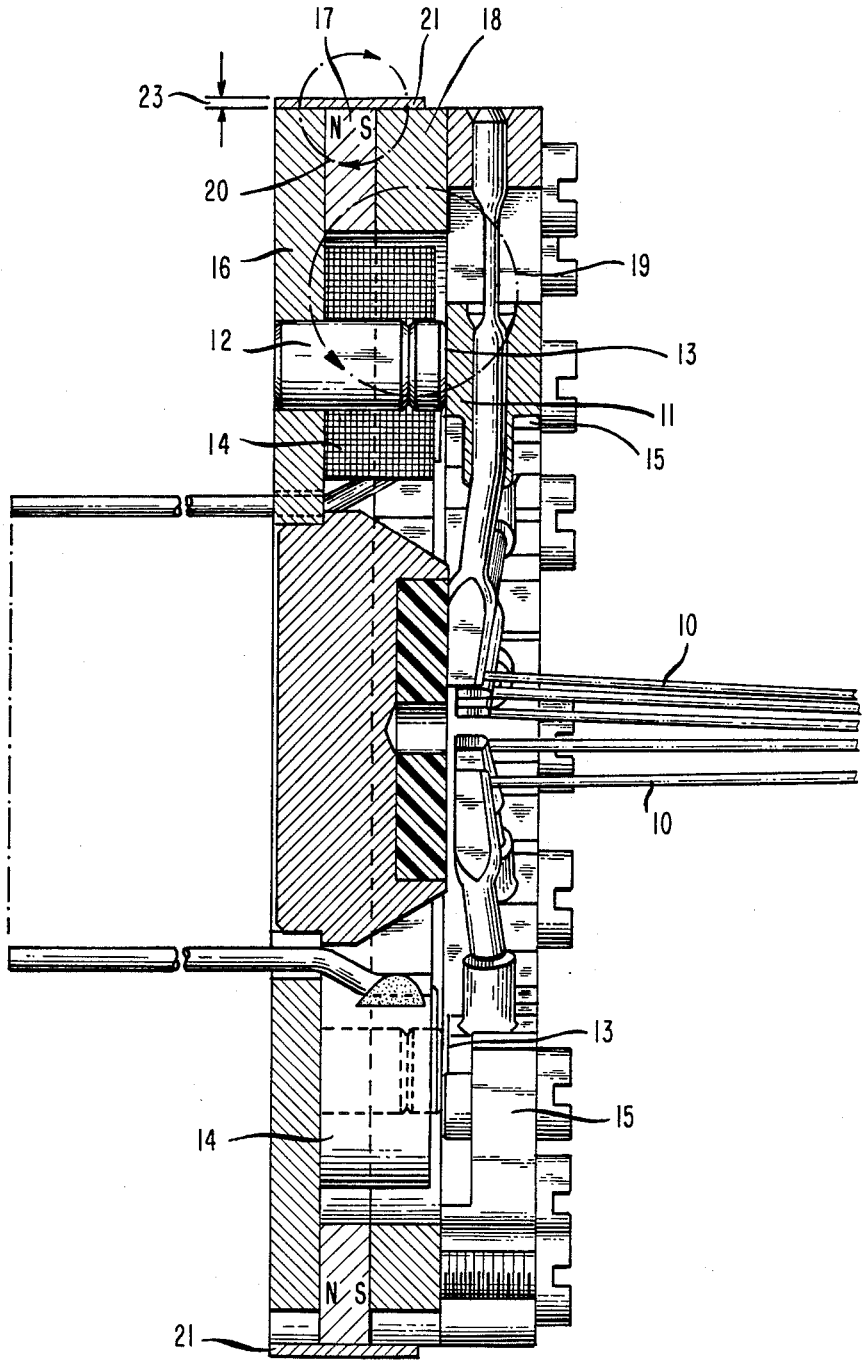
FIG. 2 is a vertical cross-section through the matrix print head according to FIG. 1 along section line II—II of FIG. 1.

The armature 11 is illustrated in FIG. 2, upper half, in rest position, i.e., the armature 11 rests fully on the coil core 12 such that the air gap 13 becomes zero. An electromagnetic coil 14 surrounds each coil core 12. The armature 11 is supported by an armature tie plate 15, where the armature tie plate 15 can move together with the armature 11 as a single unit and can then form the air gap 13 relative to the coil core 12 in the printing position of the print pin 10, as illustrated in FIG. 2, lower half. In this state, the magnetic field of a permanent magnet 17 is substantially suspended and compensated by the switched-on magnetic field of the electromagnetic coil 14. The magnetic flux of the electromagnetic circuit will seek in part the path of the lower reluctance via a shunt ring 21, since the permanent magnet 17 provides a magnetic reluctance resembling to that of air. Thereby, the degree of effectiveness of the electromagnetic flux is substantially improved, i.e., a lesser current is sufficient in order to generate a certain magnetic flux in case of a constant winding number of the electromagnetic coil 14. This process and the further processes and procedural performances are described in detail in the German Patent DE-PS 3,149,300 and, in fact, for a matrix print head of the pin construction type considered in this context.

In rest position, the course of the magnetic flux (upper part of the illustration of FIG. 2) runs back through the coil core 12, through a back plate 16, through the permanent magnet 17, through a yoke plate 18, through the armature tie plate 15 and through the armature 11, and forms the magnetic circuit, which represents a main-series magnetic circuit 19. A shunt magnetic circuit 20 is formed within the influence region of the main-series magnetic circuit, which shunt magnetic circuit comprises, in addition to the back plate 16, the permanent magnet 17 (as a ring), a yoke plate 18 (as a ring), and the shunt ring 21, which shunt ring 21 is provided with controlled dimensions.

In order to provide for an easy mounting and assembling and, respectively, an easy disassembly during operation, for example, in a test field during the testing or during service work and in order to provide a secure attachment and adhesion, the shunt ring 21 is provided with a slot 22, which provides a spring effect and elastic operation. The thickness 23 of the shunt ring can be different and depends on the field strength of the shunt magnetic circuit 20. The thickness 23 of the shunt ring 21 is less if the field effect of the shunt magnetic circuit 20 is to be small. In other words, the thickness 23 is selected to be larger where the magnetic field and magnetic flux effect of the shunt magnetic circuit 20 is to be large.

The shunt ring is rolled in the direction of rolling so that the fiber direction in the material runs in the direction of circumference of the shunt ring 21. In this manner, one also achieves a certain spring or elastic effect.

The material for the permanent magnet 17 comprises a cobalt samarium alloy or compound or a comparably powerful magnetic material. Thereby, and in view to tuning of the magnetic flux of the permanent magnet 17 which flux has to be suspended and compensated of the permanent magnet 17 by the electromagnetic coils 14, the permanent magnet 17 is provided in its thickness less than half as high as the corresponding height of the electromagnetic coil 14 in an axial direction. It follows from this that there is provided an advantageous symmetrical arrangement of the shunt ring 21 towards the left and towards the right to the cross-section of the permanent magnet 17. In this context, the electromagnetic power of the electromagnetic coil 14 is only slightly larger than the magnetic power of the permanent magnet 17.

Preferably, the permanent magnet 17 is of rectangular cross-section. The radial extension of the permanent magnet is preferably from about 1 to 3 times the thickness of the permanent magnet in axial direction, and more preferred, about 1.2 to 2.0 times the thickness of the permanent magnet. The thickness of the back plate is preferably from 0.5 to 2.0 times, and more preferably from about 0.8 to 1.2 times the thickness of the permanent magnet in axial direction. The width of the shunt ring can be from about the sum of the thicknesses of the back plate plus the permanent magnet to the sum of the thicknesses of the back plate, of the permanent magnet, and of the yoke plate and is preferably from about 0.8 times the sum of the thickness of the back plate, the permanent magnet, and the yoke plate to 0.9 times the sum of the thickness of the back plate, the permanent magnet, and of the yoke plate. The back plate is preferably disposed axially following in sequence behind the magnetic coils and behind the permanent magnet, such that the rear of the permanent magnet and of the coils are substantially flush. The core of the magnet preferably extends in the rear to slightly less than the side of the back plate remote from the coils to slightly in front of the coils. Preferably, the core of the coil extends in the rear to a point slightly less than the rear side of the back plate and in the front to slightly more forward than the front of the coil. Preferably, the coil core extends to about 0.05 to 0.10 of the thickness of the magnetic coil in a forward direction relative to the front side of the coil.

Preferably, the radial solid material width of the permanent magnet is from about 1 to 2 times the width of the coil ring between an inner radius and an outer radius.

The shunt ring thickness depends on the desired increase in magnetic flux generated by a current running through the coil. If such value for an increase in the magnetic flux generated has been established, then the thickness of the magnetic shunt ring can easily be determined experimentally versus a standard by comparing the thickness of the shunt ring at constant length of the shunt ring and by comparing the magnetic permeability of the shunt materials at the temperature range desired.

It is preferred to employ a magnetic material for the shunt ring which material shows only a slight decrease in permeability over the operational temperature range of the magnetic print head. Preferably, the material of the shunt ring has a magnetic permeability under operating conditions which does not vary more than 10% over the range of temperatures to which the print head is to be subjected. Preferably, the magnetic flux, as determined by the permeability of the magnetic materials employed in the magnetic circuit around the coil, does not vary more than 20% over the temperature range, which is to be employed by the print head, which means that the average permeability variation of the materials employed in the construction of this print head do not vary on the average more than 20% over the temperature range employed. Preferably, such temperature variation of the average permeability over the temperature range of the print head is maintained at less than 10%. The geometrical configuration of permanent magnet and shunt ring can be selected for obtaining a desired operating point on the hysteresis curve of the shunt ring for temperature compensation.

Furthermore, the shunt ring is preferably dimensioned such that the flux generated by a certain current running through the coil is increased from about 15 to 40% versus the flux generated by the coil without shunt ring and more preferably with shunt ring element, which increases the magnetic flux generated by the said current running through the coil by from about 25 to 30% versus the magnetic flux generated without shunt ring.

The magnetic reluctance is designated as such in analogy to the resistance which is encountered by an electric current. The definition of magnetic reluctance is a quotient of current running through a coil divided through the magnetic flux generated by that current. The larger the magnetic flux generated by a certain current, the smaller is the magnetic reluctance. In general, the magnetic reluctance is proportional to the length of the path taken by a magnetic flux line and inversely proportional to the magnetic permeability and to the area over which the magnetic flux extends sideways. The magnetic reluctance is frequently called magnetic resistance, too. References to these definitions can be found, for example, in the book "Static Electromagnetic Devices" by William T. Hunt, Jr., and Robert Stein, Publisher: Allan & Bacon Inc., Boston, 1970, p. 20, and by L. Bergman, C.L. Schaefer, Textbook of Experimental Physics, Volume II, Walter de Gruyter & Co., Berlin, 1956, page 198.

The upper part of FIG. 2 illustrates the stationary situation of the magnetic circuit together with the armature. The magnetic circuits generated by the permanent magnet 17 are shown at 19 and 20. Since the permanent magnet is continuously present, such magnetic field strengths are continuously generated by the permanent magnet.

In case now where the electromagnet is operated, then in addition to the field generated by the permanent magnet 17, there also occurs the field caused by the current running through the electromagnetic coil 14 and generating an induced magnetic field, in particular, in the magnetic core 12. This additional magnetic field, generated by the current running by the electromagnetic coil in operating condition, is generally superposed to the magnetic field generated by the permanent magnet. While the upper part of FIG. 2 illustrates the magnetic flux and magnetic field situation, induced by the permanent magnet, the same field and flux situation caused by the permanent magnet is also present in case where the electromagnet is switched on, however, a superposition takes place such that the magnetic field and flux generated by the electromagnet are superimposed to the magnetic field and flux generated by the permanent magnet. The lower part of FIG. 2 illustrates only the electromagnetic field and flux generated by the electromagnet even though the permanent magnet field and flux are simultaneously present and active as illustrated in the upper part of FIG. 2. However, for simplicity's sake, these underlying magnetic fields and fluxes are not repeated in the lower part of FIG. 2. It can be recognized from FIG. 2 that the superimposed field and flux of the electromagnet are directed opposite to those of the permanent magnet within the area of the magnetic coil core of the electromagnet and thereby causing the firing of the print pin. It can further be recognized that the shunt ring 21 influences the field and flux generated and passing through the magnetic core during the operation of the electric current in the coil. Appropriate selection of the dimensions and of the material of the magnetic shunt ring 21 allows to adjust and to vary the magnetic flux generated in the magnetic coil core 12 based on a certain predefined current strength. It has been found in the context of the present invention that it is particularly advantageous if a magnetic shunt ring is employed which increases the magnetic flux generated by a certain current in the magnetic coil core 12 by from about 20 to 60% and preferably by from about 33 to 43%. Such increase in the magnetic flux increases in a print head configuration and allows to decrease the current running through the electromagnetic coil by a corresponding amount in order to obtain the same force effect onto the armature. Thereby, such a device runs at a lower power.

A preferred material for providing the magnetic circuit includes for example a cobalt iron alloy with 50% cobalt and achieving a maximum permeability of about 15,000. The silicon iron preferably contains about 3% silicon and a carbon content of less than 0.2% such as the material designated as St4LG and such material can have a maximum permeability of at least about 30,000 and more.

The magnetic shunt ring is preferably disposed such that it provides a maximum magnetic bypass of the permanent magnet for a magnetic flux generated by the electromagnet of the armature corresponding to a print pin. The resulting magnetic flux circuit involving the electromagnet and the magnetic shunt ring is illustrated at 29. It is noted that inside the coil core 12, the direction of the flux 29, resulting from the electromagnet, is opposite to that of the flux, resulting from the permanent magnet and designated as 19.

Since the magnetic flux generated in the magnetic shunt ring by the permanent magnet and that generated by the electromagnet have a substantial parallel direction, it is desirable that the permanent magnet does not drive the magnetic shunt ring into saturation but leaves it in such state that any additional superposed magnetic field encounters a high magnetic permeability in order to allow for the generation of a large magnetic flux. And preferably, the magnetic shunt ring is dimensioned such that it operates in the absence of a current running through the electromagnetic coil in a state of near maximum permeability.

It will be understood that each of the elements described above, or two or more together, may also find a useful application in other types of print heads differing from the types described above.

While the invention has been illustrated and described as embodied in the context of a matrix print head, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the following claims:

1. A matrix print head comprising
an individual pin print element;
an electromagnetic coil forming part of an electromagnetic circuit coordinated to the individual pin print element;
a coil core disposed in the electromagnetic coil;
a back plate;
a permanent magnet is furnished with a substantially lower magnetic flux as compared with the corresponding electromagnetic coil;
a yoke plate;
a springing armature, where the individual pin print element is attached to said springing armature, and where the springing armature is disposed opposite to the coil core of the electromagnetic coil and wherein the armature, the core of the coil, the back plate, the permanent magnet, and the yoke plate form a main-series magnetic circuit and where the springing armature rests in its rest position on the core of the coil;
a shunt ring forming part of a shunt magnetic circuit coordinated to the main series magnetic circuit, which shunt magnetic circuit is formed by the back plate, the permanent magnet, the yoke plate, and a shunt ring, and wherein the total extension of the shunt ring in a direction parallel to an axis of the coil is at least two times the extension of the permanent magnet in the same direction.

2. The matrix print head according to claim 1, wherein the magnetic properties of the shunt ring reduce the magnetic reluctance of the magnetic circuit passing through the coil by at least about 20 percent as compared with this magnetic circuit in the absence of the shunt ring.

3. The matrix print head according to claim 1, wherein the material for the shunt ring comprises materials selected from the group consisting of silicon iron and of magnetic materials having a maximum permeability of at least 7000 at a ferromagnetic coercitivity of less than 0.3 and a magnetic flux of at least up to 20,000 gauss.

4. The matrix print head according to claim 1, wherein the thickness of the shunt ring is variable depending on the main-series magnetic circuit including the permanent magnet based on a supply of several shunt rings with different thicknesses furnished for determination of an optimal operating point.

5. The matrix print head according to claim 1, wherein the magnetic shunt ring is produced from a rolled metal alloy, and where the circumferential direction coincides with the direction of the rolling.

6. The matrix print head according to claim 1, wherein the material for the permanent magnet is selected from the group consisting of cobalt samarium alloy (CoSm), high ferromagnetic remanence materials having a Curie temperature of at least about 700° C., and mixtures thereof.

7. The matrix print head according to claim 1, wherein the magnetic flux, generated by the coil when energized, is increased by at least about 25 percent by a soft ferromagnetic shunt ring extending in a direction parallel to the coil axis and connecting the back plate and the yoke for decreasing the magnetic reluctance encountered by the magnetic field generated by the coil.

8. The matrix print head according to claim 1, wherein the magnet ring is disposed within the cylinder formed by the shunt ring;

wherein the magnetic properties of the shunt ring reduce the magnetic reluctance of the magnetic circuit passing through the coil by at least about 20 percent as compared with this magnetic circuit in the absence of the shunt ring;

wherein the material for the shunt ring comprises materials selected from the group consisting of silicon iron and of magnetic materials having a maximum permeability of at least 7000 at a ferromagnetic coercitivity of less than 0.3 and a magnetic flux of at least up to 20,000 gauss;

wherein the thickness of the shunt ring is variable depending on the main-series magnetic circuit including the permanent magnet based on a supply of several shunt rings with different thicknesses furnished for determination of an optimal operating point;

wherein the magnetic shunt ring is produced from a rolled metal alloy, and where the circumferential direction coincides with the direction of the rolling; wherein the material for the permanent magnet is selected from the group consisting of cobalt samarium alloy (CoSm), high ferromagnetic remanence materials having a Curie temperature of at least about 700° C., and mixtures thereof; wherein the magnetic flux, generated by the coil when energized, is increased by at least about 25 percent by a soft ferromagnetic shunt ring extending in a direction parallel to the coil axis and connecting the back plate and the yoke for decreasing the magnetic reluctance encountered by the magnetic field generated by the coil;

wherein the shunt ring has a center of gravity and wherein the magnet ring does not extend in axial direction, from a plane perpendicular to the axis of the shunt ring and passing through the center of gravity, by more than 0.4 times the total extension of the shunt ring in axial direction;

wherein the shunt ring has an extension in a direction parallel to the axis of the shunt ring of at least 0.7 times the length in axial direction of the coil core and of not more than the length in axial direction of the coil core; wherein the extension in axial direction of the shunt ring is at least twenty times the thickness of the shunt ring;

wherein the shunt ring overlaps the back plate over a length in axial direction of at least 0.8 times the length in axial direction of the back plate and wherein the shunt ring overlaps the yoke plate in axial direction by at least about 0.5 times the extension of the yoke plate in axial direction and wherein the distance of the shunt ring from the magnet ring is less than the thickness of the shunt ring.

9. The matrix print head according to claim 8, wherein the shunt ring has a center of gravity and wherein the magnet ring does not extend in axial direction, from a plane perpendicular to the axis of the shunt ring and passing through the center of gravity, by more than 0.4 times the total extension of the shunt ring in axial direction.

10. The matrix print head according to claim 1, wherein the shunt ring has an extension in a direction parallel to the axis of the shunt ring of at least 0.7 times the length in axial direction of the coil core and of not more than the length in axial direction of the coil core.

11. The matrix print head according to claim 1, wherein the extension in axial direction of the shunt ring is at least twenty times the thickness of the shunt ring.

12. The matrix print head according to claim 1, wherein the shunt ring overlaps the back plate over a length in axial direction of at least 0.8 times the length in axial direction of the back plate and wherein the shunt ring overlaps the yoke plate in axial direction by at least about 0.5 times the extension of the yoke plate in axial direction and wherein the distance of the shunt ring from the magnet ring is less than the thickness of the shunt ring.

13. A method for reducing electrical energy input into matrix print heads comprising disposing a coil core in an electromagnetic coil coordinated to an individual pin print element;

placing a back plate on a rear side of the electromagnet coil;

disposing a permanent magnet ring eccentrically around the electromagnetic coil and where the permanent magnet is disposed closely relative to the back plate on the front side of the back plate;

disposing a yoke plate eccentrically and substantially more toward the outside of the print head around the electromagnetic coil and where the yoke plate is disposed closely relative to the front side of the permanent magnet ring;

attaching an individual pin print element to a springing armature;

positioning the springing armature opposite to the coil core of the electromagnetic coil such that the armature, the core of the coil, the back plate, the permanent magnet, and the yoke plate form a main-series magnetic circuit;

rolling a soft ferromagnetic alloy;

forming a soft ferromagnetic shunt ring of the rolled soft ferromagnetic alloy such that the circumferential direction of the soft ferromagnetic shunt ring coincides with the rolling direction;

surrounding the permanent magnet ring with the soft ferromagnetic shunt ring for forming a shunt magnetic circuit coordinated to the main-series magnetic circuit, which shunt magnetic circuit is formed by the back plate, the permanent magnet, the yoke plate, and a shunt ring energizing the electromagnetic coil for moving the springing armature from its rest position on the coil core to a position at a distance from the core coil.

14. A matrix print head with electromagnetic circuits coordinated to individual pin print elements, where the pin print elements are in each case attached to springing armatures which, in each case, are disposed opposite to the coil core of an electromagnetic coil and where the armature, the core of the coil, the back plate, a permanent magnet, and a yoke plate form a main-series magnetic circuit, where the armature rests in its rest position on the core of the coil, where furthemore a shunt magnetic circuit is coordinated to each main-series magnetic circuit, which shunt magnetic circuit is formed by the back plate, the permanent magnet, the yoke plate, and a soft ferromagnetic shunt ring, wherein the magnetic shunt ring (21) is produced from a rolled metal alloy, where the circumferential direction of the shunt ring coincides with the direction of the rolling of the metal alloy, wherein the permanent magnet (17) of the main-series magnetic circuit (19) is provided with a substantially lower magnetic flux as compared with the corresponding electromagnetic coil (14).

15. The matrix print head according to claim 14, wherein the magnetic material for the shunt ring (21) exhibits a lower magnetic reluctance.

16. The matrix print head according to claim 14, wherein the material for the shunt ring (21) comprises materials selected from the group consisting of silicon iron and of magnetic materials having a maximum permeability of at least 7000 at a coercitivity of less than 0.3 and a magnetic flux of at least up to 20,000 gauss.

17. The matrix print head according to claim 14, wherein the thickness (23) of the shunt ring (21) is variable depending on the main-series magnetic circuit (19) including the permanent magnet (17) and where several shunt rings (21) are furnished with different thicknesses (23) for determination of the operating point.

18. The matrix print head according to claim 14, wherein the material for the permanent magnet (17) is provided with a cobalt samarium alloy (CoSm) or provided by a material selected from the group consisting of cobalt samarium (CoSm) and magnetically effective materials having a Curie temperature of at least about 700° C.

19. The matrix print head according to claim 14, wherein the magnetic field strength and the magnetic flux generated by the coil is increased by a soft ferromagnetic shunt ring extending in a direction parallel to the coil axis and connecting the back plate and the yoke for decreasing the magnetic reluctance encountered by the magnetic field generated by the coil.

20. The matrix printhead according to claim 1 wherein the soft ferromagnetic shunt ring 21 is provided with a slot for easy handling;

wherein the soft ferromagnetic shunt ring is made of a material rolled so that an orientation direction in the material runs in the direction of circumference of the shunt ring;

wherein the permanent magnet is provided in its thickness less than half as high as the corresponding height of the electromagnetic coil 14 in an axial direction; wherein the electromagnetic power of the electromagnetic coil is only slightly larger than the magnetic power of the permanent magnet;

wherein the magnetic flux, as based on the permeability of the magnetic materials employed in the magnetic circuit around the coil, does not vary more than 20% over the temperature range, which is to be employed by the print head, which means that the average permeability variation of the materials employed in the construction of this print head do not vary on the average more than 20% over the temperature range employed.

21. The matrix printhead according to claim 1 wherein the permanent magnet is of rectangular cross-section;

wherein the radial extension of the permanent magnet is from about 1 to 3 times the thickness of the permanent magnet in axial direction;

wherein the thickness of the back plate is from 0.5 to 2.0 times the thickness of the permanent magnet in axial direction;

wherein the width of the shunt ring is from about the sum of the thicknesses of the back plate plus the permanent magnet to the sum of the thicknesses of the back plate, of the permanent magnet, and of the yoke plate;

wherein the back plate is disposed axially following in sequence behind the magnetic coils and behind the permanent magnet, such that the rear of the permanent magnet and of the coils are substantially flush;

wherein the core of the magnet extends in the rear to slightly less than the side of the back plate remote from the coils to slightly in front of the coils;

wherein the radial solid material width of the permanent magnet is from about 1 to 2 times the width of the coil ring between an inner radius and an outer radius;

wherein the soft ferromagnetic shunt ring exhibits only a slight decrease in permeability over the operational temperature range of the magnetic print head.

22. The matrix printhead according to claim 1 wherein the material of the shunt ring has a magnetic permeability under operating conditions which does not vary more than 10% over the range of temperatures to which the print head is to be subjected under operating conditions; wherein the shunt ring is constructed such that a flux generated by a certain current running through the coil is increased from about 15 to 40% as compared with a flux generated by the coil without shunt ring;

wherein the magnetic shunt ring increases a magnetic flux generated by a certain current in the magnetic coil core by from about 20 to 60%;

wherein the material of the shunt ring includes a cobalt iron alloy with 50% cobalt and achieving a maximum permeability of about 15,000;

wherein the magnetic shunt ring is disposed for providing a maximum magnetic bypass of the permanent magnet for a magnetic flux generated by the electromagnet of the armature corresponding to a print pin;

wherein the permanent magnet does not drive the soft ferromagnetic shunt ring into saturation but leaves it in such state that any additional superposed magnetic field encounters a high magnetic permeability in order to allow for the generation of a large magnetic flux, wherein, the magnetic shunt ring is dimensioned such that it operates in the absence of a current running through the electromagnetic coil in a state of near maximum permeability.

23. The matrix printhead according to claim 1 wherein a radial extension of the permanent magnet is preferably from about 1.2 to 2 times the thickness of the permanent magnet in axial direction;

wherein a thickness of the back plate is from about 0.8 to 1.2 times the thickness of the permanent magnet in axial direction;

wherein a width of the shunt ring is from about 0.8 to 0.9 times the sum of the thickness of the back plate, the permanent magnet, and of the yoke plate;

wherein the core of the coil extends in the rear to a point slightly less than the rear side of the back plate and wherein the core of the coil extends to about 0.05 to 0.10 of the thickness of the magnetic coil in a forward direction relative to the front side of the coil;

wherein the magnetic flux, as determined by the permeability of the magnetic materials employed in the magnetic circuit around the coil, does not vary more than 10% over the operating temperature range, which is to be employed by the print head;

wherein the average permeability variation of the materials employed in the construction of this print head do not vary on the average more than 10% over the temperature range employed for operation of the print head; wherein the shunt ring is constructed such that a flux generated by a certain current running through the coil is increased from about 25 to 30% versus the flux generated by the coil without shunt ring;

wherein the magnetic shunt ring increases the magnetic flux generated by a certain current in the magnetic coil core by from about 33 to 43%;

wherein the material of the shunt ring includes a silicon iron alloy contains about 3% silicon and having a carbon content of less than 0.2%;

wherein the material of the shunt ring reaches a permeability of about 30,000.

* * * * *